United States Patent [19]

Betts

[11] Patent Number: 4,683,008

[45] Date of Patent: Jul. 28, 1987

[54] METHOD FOR CLEANING HARD SURFACES

[75] Inventor: James F. Betts, Akron, Ohio

[73] Assignee: Sparkle Wash, Inc., Bedford Heights, Ohio

[21] Appl. No.: 754,860

[22] Filed: Jul. 12, 1985

[51] Int. Cl.[4] ..... B08B 3/02; B08B 3/08; C11D 3/075

[52] U.S. Cl. ..... 134/27; 134/28; 134/29; 134/34; 252/156; 252/526; 252/527; 252/528; 252/529; 252/540; 252/545; 252/546; 252/547; 252/548; 252/559; 252/DIG. 14

[58] Field of Search ..... 252/156, 526, 527, 528, 252/529, 545, 546, 547, 548, 559, 540, DIG. 14; 134/27, 28, 29, 40

[56] References Cited

U.S. PATENT DOCUMENTS

| | | | |
|---|---|---|---|
| 3,329,616 | 7/1967 | Felerstein | 252/539 |
| 3,494,795 | 2/1970 | Chang | 134/40 |
| 3,507,798 | 4/1970 | Egan et al. | 252/135 |
| 3,609,089 | 9/1971 | Cantrell et al. | 252/529 |
| 3,650,831 | 3/1972 | Jungermann et al. | 134/27 |
| 3,709,838 | 1/1973 | Mausner et al. | 252/545 |
| 3,738,943 | 6/1973 | Kaneko | 252/540 |
| 3,826,759 | 7/1974 | Inamorato et al. | 252/525 |
| 3,910,855 | 10/1975 | Abeles | 252/527 |
| 3,935,129 | 1/1976 | Jabalee | 252/525 |
| 3,962,149 | 6/1976 | Chirash et al. | 252/540 |
| 3,970,595 | 7/1976 | Ginn et al. | 252/545 |
| 3,973,998 | 8/1976 | Datta et al. | 148/6.14 R |
| 4,040,989 | 7/1977 | Renaud et al. | 252/548 |
| 4,174,304 | 11/1979 | Flanagan | 252/524 |
| 4,228,043 | 10/1980 | Vandem Brom | 252/529 |
| 4,247,408 | 1/1981 | Imamura et al. | 252/143 |
| 4,276,205 | 6/1981 | Ferry | 252/528 |
| 4,348,292 | 9/1982 | Ginn | 252/90 |
| 4,390,465 | 6/1983 | Spekman, Jr. | 252/527 |
| 4,436,653 | 3/1984 | Jacobson et al. | 252/547 |
| 4,472,205 | 9/1984 | Cortner | 134/27 |
| 4,507,219 | 3/1985 | Hughes | 252/118 |

FOREIGN PATENT DOCUMENTS 1300699 6/1962 France .

OTHER PUBLICATIONS

Leaflet-Personal Care Products, (Liquid Hand Soaps).
Leaflet-Household Cleaners-(Light Duty Liquids).
Leaflet-Industrial Applications, (Hard Surface Cleaners).
Leaflet-Household Cleaners (Laundry Prespotters).
Leaflet-General Applications, (All-Purpose Cleaners).

*Primary Examiner*—Prince E. Willis
*Attorney, Agent, or Firm*—Pearne, Gordon, McCoy & Granger

[57] ABSTRACT

This invention relates to a novel alkaline detergent and the use thereof in cleaning a variety of substrates either alone or with prior treatment with acidic detergent solutions. Specifically, the invention relates to a unique combination of surfactants with detergents and various builder salts and the use of the detergent solutions in a process for washing a variety of substrates. The alkaline detergent composition comprises a mixture of alkoxylated non-ionic surfactants in combination with high molecular weight anionic detergents comprising amine and alkali metal salts of sulfonic acids and sulfates together with tertiary amine oxides and/or alkanol amides and builder salts including the inorganic metal salts and salts of lower molecular weight polycarboxylic acids. The detergent compositions of this invention are particularly useful in spray equipment whereby dilute aqueous solutions are applied to the substrates under pressure. Depending on the type and condition of the substrate, the surface may be pretreated with an acidic solution of detergent and subsequently washed with an aqueous solution of the alkaline detergent.

8 Claims, No Drawings

METHOD FOR CLEANING HARD SURFACES

BACKGROUND OF THE INVENTION

This invention relates to alkaline detergent compositions comprising a unique combination of water soluble non-ionic surfactants and anionic detergents together with other water soluble surfactants, i.e. amine oxides or amides, and at least one builder salt in an alkaline aqueous solution. More specifically, this invention is directed to a water soluble alkaline detergent particularly useful in cleaning various substrates by first treating the substrate with dilute acidic solutions of detergents and subsequently washing the acidic treated surface with an alkaline detergent comprising an aqueous solution of a mixture of an alkoxylated non-ionic surfactant and anionic detergents with water soluble amine oxides or amides and at least one builder selected from the group consisting of inorganic metal salts and polycarboxylic acid metal salts.

The detergent compositions of this invention are specifically adapted for cleaning various surfaces including brick, wood or metal substrates such as homes, buildings, cars, trucks, railroad cars and the like, and are particularly useful in spray equipment. More specifically, this invention is directed to novel detergent compositions and the method of using said compositions for performing various cleaning operations on different substrates included painted surfaces and are particularly useful for cleaning and restoring the surfaces where soil is heavy and frequently combined with oily or greasy materials. Moreover, substrates which are heavily weathered and highly oxidized have soil embedded in the paint and therefore, are even more difficult to clean. It is generally accepted that most surfaces containing greasy materials or the like may be cleaned by the use of acidic solutions. Acid solutions alone, however, were found not to be totally effective without deleteriously effecting the surface. Further, where alkaline cleaners have been used in place of the acid cleaners, such alkaline cleaners were not particularly outstanding with respect to soiled surfaces containing oxides embedded in the paint and therefore were not capable of restoring the surfaces to their original or near original condition.

In accordance with this invention, the method comprises the use of acidic detergent solutions followed sequentially with an alkaline wash comprising a unique mixture of an alkoxylated non-ionic surfactant, and an anionic detergent coupled with an amine oxide and/or amide in combination with builder salts such as the inorganic metal salts. The amine oxides or amides are added to the alkaline detergent for various reasons including, for example, to control the frothing action which prevents evaporation of water and therefore allows the detergent to remain on the surface, e.g. vertical surfaces at increased concentrations to obtain improved cleansing action. The detergent compositions of this invention are preferrably sprayed onto the substrate at increased pressures to dissolve any organic materials and effectively penetrate and remove the dirt embedded in the surface.

The use of either acidic or alkaline detergents as cleaning fluids with spray equipment is generally known. For example, U.S. Pat. No. 3,709,838 discloses a detergent containing ethanol amine salts of sulfonic acid in combination with non-ionic surfactants. U.S. Pat. No. 3,826,759 discloses a non-foaming detergent comprising a combination of non-ionic and anionic detergents with inorganic builder salts. U.S. Pat. No. 4,040,989 discloses a liquid detergent containing anionic detergents such as the sulfonates in combination with a non-ionic detergent with an alkanoic acid amide. In comparison to the teachings of the prior art, however, the instant invention is directed to a synergistic combination of certain water soluble non-ionic surfactants and anionic detergents in combination with amine oxides or alkanolamides with inorganic and organic builder salts.

Accordingly, it is an object of this invention to improve the technique for cleaning badly weathered surfaces with particular detergents. It is another object of this invention to provide a unique combination of detergents with surface active agents and builder salts capable of being used in high pressure spray equipment. It is a further object of this invention to provide a unique composition particularly useful in spray equipment for cleaning and/or degreasing various substrates at various temperatures and pressures. It is a further object of this invention to provide a process wherein the substrate is initially treated with an acidic solution of acid stable detergents and subsequently washing with a water soluble alkaline detergent in pressure equipment to restore and clean the surface of the substrate.

These and other objects will become apparent from a further more detailed description of the invention as follows:

SUMMARY OF THE INVENTION

In accordance with this invention, a unique composition is provided for use in washing various substrates and particularly an aqueous alkaline detergent capable of being used effectively with high pressure spray equipment. The detergent composition of this invention comprises a combination of water soluble compounds comprising from about 10 to about 50 parts by weight of at least one alkoxylated non-ionic surfactant and particularly 20 to 40 parts by weight of an alkoxylated non-ionic surfactant having up to 18 carbon atoms per molecule and approximately 10 to 90, e.g. 60 to 80 parts by weight of at least one anionic detergent such as the amine and inorganic alkali metal salts of alkyl aryl sulfonic acids in combination with effective amounts, i.e. ranging from 5 to 90 parts by weight of the total composition of a builder selected from the group consisting of inorganic metal salts and certain low molecular weight polycarboxylic acid salts and approximately 1 to 30 parts by weight of a surfactant selected from the group consisting of water soluble amine oxides and particularly the tertiary amine oxides and/or the alkanolamides. The alkaline detergents are dissolved in various amounts of water depending on the concentration required ranging from about 10 to two million parts by weight of water per part by weight of the detergent compositions. Preferably the detergent compositions are solubilized in 50 to one million or 100 to one million parts by weight of water. The alkalinity of the aqueous solution containing the alkaline detergent is maintained by the addition of at least one or more alkali metal hydroxide including the combination of sodium and potassium hydroxides. Sufficient amounts of hydroxide are added to the aqueous medium to maintain the detergent systems at an alkaline pH greater than 7.5 and preferrably at a pH ranging from 9.0 through 14.

The aqueous alkaline detergent is utilized in a process of cleaning various substrates including substrates of wood, metal, brick and the like which comprises initially treating the substrate with dilute acid solutions containing at least one detergent such as an acid stable detergent in hydrofluoric acid having a pH ranging from 2 to 7, and subsequently washing the substrate treated with the acidic solutions of detergent with the alkaline detergent.

DETAILED DESCRIPTION

More specifically, the non-ionic surfactants useful for purposes of this invention are in aqueous solution in amounts ranging from 10 to 50 parts by weight of the total composition and preferrably in amounts ranging from 20 to 40 parts by weight. These water soluble surfactants include the alcohol alkoxylates such as the penta, octa, nona, or deca alkoxylates. These alkoxylates can be derived from both primary and secondary alcohols and preferrbly include the secondary alcohol alkoxylates marketed under the trade name Tergitol which comprises alcohols having a higher number of carbon atoms condensed with several moles of ethylene oxide per equivalent of alcohol.

In addition, other alkoxylates are the alkyl phenolic alkoxylates including the alkoxylated alkyl phenols such as nonylphenol, decylphenol, dodecylphenol, octylphenol, etc. Other alkoxylates include the olefinic alkoxylates derived from alkanyl alcohols and alkenyl phenols. In addition to the higher molecular weight long chain alkoxylates, combinations may be used including the short chain alkoxylated non-ionic surfactants such as the primary alcohol alkoxylates derived from the lower molecular weight alcohols. These alkoxylates may be employed as simple compounds or as mixtures as generally found in the commercial products. The mixtures have average degrees of alkoxylation and an average lithophilic hydrocarbon chain characterized as having HLB numbers in the range of 9 through 13.

The non-ionic surfactants particularly preferred for purposes of this invention are obtained commercially under the trade names Tergitol. These compounds are disclosed in the literature and in U.S Pat. Nos. 2,164,431; 3,650,965; 2,508,035; and 2,335,823. These non-ionic surfactants may be derived from the condensation of alcohols and alkyl phenols with ethylene oxide. Particularly preferred are the hydroxy-containing linear polymers of lower alkyl oxides such as ethylene and propylene oxides. More specifically, the most preferred products include the condensation products of higher fatty alcohols with lower alkyl glycols such as the Neodols which have 10 to 16 carbon atoms. The Neodols are disclosed in the Neodol Products Formulary by Shell Chemical Company of West Orange, N.J.

The water soluble anionic detergents used in combination with the water soluble non-ionic surfactants for purposes of this invention include compounds which contain sufficient hydrophobic groups and an anionic solubilizing group such as the high molecular weight sulfonates and sulfates. These anionic detergents include the water soluble salts such as the water soluble salts which have at least 12 carbon atoms including the alkali metal and amine salts of the alkyl aryl sulfonic acids. Particularly useful as the water soluble anionic detergents are the higher alkyl benzene sulfonates having at least 16 carbon atoms including the amine or alkali metal sulfonates. These sulfonate salts are known in the detergent art and are described in the text *Surface Active Agents and Detergents,* Vol. II, Schwartz & Perry, InterScience Publishers Inc. (1958).

In addition to the higher molecular weight salts of sulfonic acids, other water soluble anionic detergents include the alkyl sulfates such as the higher alkyl sulfates, e g. the higher fatty acid glyceride sulfates. Examples of the sulfates of higher alcohols include sodium lauryl sulfate, sodium tallow alcohol sulfate, and the sulfates of the mono or diglycerides of fatty acids. More specifically, examples of the detergents useful for purposes of this invention include sodium tridecyl benzene sulfonate, dodecyl benzene sulfonate, lauryl sulfate, etc. O these sulfonates and sulfates, the most preferred include the water soluble anionic detergents known as the alkali metal and alkaline earth metal salts of the higher $C_{12}$ to $C_{22}$ alkyl benzene sulfonates. In addition to the metal sulfonates, other sulfonate detergents useful for purposes of this invention include the amine salts of the alkyl benzene sulfonates having from 12 to 22 carbon atoms in the alkyl group.

In order to improve the detergency of the composition, it was found necessary to incorporate in combination with the non-ionic surfactant and anionic detergent relatively critical amounts of water soluble amino compounds such as the alkanolamides of higher alkanoic acids. The alkanol amides are the reaction products of lower weight alkanolamines and alkanoic acids having 10 to 16 carbon atoms. These amides may be derived from mixtures of alkanoic acids such as mixtures of lauric and myristic acids. Specific amides include monoethanol amide, diethanol amide, isopropanol amides, etc.

In lieu of the alkanoic acid amides or alkanol amides, other water soluble surfactants that may be used include the alkyl tertiary amine oxides such as the trialkylamine oxides having up to 16 carbon atoms. These amine oxides are usually combinations of the lower and higher alkyl amine oxides wherein the lower alkyl group has 1 to 6 carbon atoms and the higher alkyl group has 8 to 16 carbon atoms per molecule. One or more of these amine compounds may be used either alone or in combination with others. For example, mixtures of the alkanoic acid amides may be used alone or in combination with various $C_8$–$C_{16}$ tertiary alkylamine oxides such as the alkyl dimethylamine oxides, etc.

In addition to the alkoxylated non-ionic surfactants in combination with the higher anionic detergents, i.e. the higher sulfonic acid salts, the detergency of the washed liquid can be improved by incorporating in the mixture certain organic and/or inorganic builder salts. The builder salts are used at concentrations ranging from about 5 to 90 parts but generally from 10–60 parts by weight of the total composition. The aqueous detergent composition of this invention must contain at least one inorganic metal salt and/or salt of a polycarboxylic acid including the water soluble salts of phosphates, carbonates, silicates, carboxylates and the like. Specific examples include the water soluble inorganic sodium and potassium salts such as the tripolyphosphates and pyrophosphates. Other inorganic water soluble salts include the carbonates and silicates such as the alkali metal bicarbonates and silicates. In addition to detergency, the builder salts help to provide the alkalinity for the aqueous system which is maintained at a pH ranging from 7.5 to 14.

In addition to the water soluble inorganic salts other builders include the water soluble salts of the low molecular weight polycarboxylic acids such as salts of ethylene diamine tetracetic acid, e.g. the alkali metal salts, salts of mellitic acid, citric acid and the like. More specifically, the builder salts may include mixtures of sodium carbonate, sodium silicate, sodium citrate, sodium succinate, sodium mellitate, the sodium salt of ethylenediamine tetracetic acid and various mixtures thereof in any proportion. These salts are recognized compounds for use in detergent compositions as set forth in U.S. Pat. Nos. 3,308,067; 3,400,148; 3,213,030 and 3,422,021

The detergent of this invention may be formulated as a concentrate and then used in spray equipment such as a mobil unit having high pressure spray equipment. The spray equipment should be capable of diluting and carrying the alkaline detergent and acidic solution of detergents through feedlines at nozzle pressures ranging from about 50 psi to 3000 psi, and more likely at application pressures ranging from about 50 to 600 psi, e.g. 100 to 600 psi. The concentrated detergents may be diluted in the spray equipment to ratios ranging from 1.0 to 100 parts by weight of concentrate with up to two million parts by weight of water. Generally, the aqueous concentrates are diluted with water to ratios of approximately 1 to 100 parts by weight of concentrate (Example B) with up to one million parts by weight of water. The water, if necessary, may be heated or used at ambient temperatures with very dilute or relatively concentrated aqueous solutions of the detergents.

The alkaline detergent may be used alone to wash the substrate without prior treatment depending on the condition of the surface, or alternatively the substrate may be initially treated with an aqueous solution of acid stable detergents in a mineral acid such as sulfuric, nitric, hydrochloric or hydrofluoric acids. The acidic detergent comprises an acid stable detergent in aqueous acid solutions, e.g. containing at least one nonionic or amphoteric detergent in acid solution. The detergent includes the fatty amine oxides, e.g. dodcecyl dimethyl amine oxide, lauryl dialkyl amine oxide; the fatty alkanol amides, e.g. alkanoic acid amides, the hydroxy-containing polymers of alkylene oxides such as ethylene and propylene oxides. Specifically, the non-ionic detergents may include the condensation products of higher fatty alcohols with lower alkylene oxides such as Neodol 45-11, Deodals 25-3, Neodols 25-7, Pluronics, and Igepals. The amphoteric detergents that may be used in the acid solution includes the substituted aminopropionic acid salts, the fatty imidazolines, and the betaines such as salts of alkyl aminolauric acid, etc. The condition of the surface and the type of surface being treated will dictate the concentration of the acidic detergent solutions. Generally, however, the acidic detergent used for treatment of the substrate is diluted with water and generally has a pH ranging from 3 to 6. In some instances where a more harsh treatment of the surface is required, the pH of the acidic detergent may be lowered to a pH of 3.0 or lower. Subsequent to the treatment of the substrate with the acidic detergent solution, the alkaline detergent is applied generally by spraying under sufficient application pressures to remove all of the soil or dirt previously treated with the acidic detergent.

The preferred method of applying the acidic detergent and the subsequent alkaline detergent is by using spray equipment capable of creating nozzle pressures ranging as high as 3000 psi. As a practical matter, however, the acidic treatment and subsequent alkaline wash are applied to the substrates at nozzle pressures ranging from 50 to 600 psi with the nozzle being maintained at a distance anywhere from 6 or more inches from the surface. In some instances, depending on the condition and type of substrate being treated, the acidic detergent may be allowed to remain on the surface for a period sufficient to adequately react with the soil and then followed by the alkaline detergent wash.

As a specific illustration, a mobil unit known as "Sparkle Wash" is used to apply both the aqueous acidic detergent pretreating solution and the alkaline detergent solution. The mobil units have power spray equipment capable of continuous application pressures ranging up to 3000 psi or greater, e.g. from 10 to 400 and are capable of diluting both detergent compositions with sufficient water to obtain very dilute solutions.

The following examples illustrate the effectiveness of the alkaline detergent composition of this invention and the use thereof for treating and cleaning a variety of substrates. A comparison of the various compositions (1 to 35) were made by utilizing a scale wherein (A) is designated as completely cleaned, (B) significantly cleaned, (C) slightly cleaned and (D) no cleaning action beyond that obtained with rinse water.

EXAMPLES

EXAMPLE A

| Components | Parts by Weight |
|---|---|
| Alkanol amides or t-amine oxides | 1 to 30 |
| Triethanolamine | 0 to 15 |
| Dodecyl Benzene Sulfonic Acid amine salt | 10 to 90 |
| Sodium Xylene Sulfonate | 10 to 50 |
| Neodol (Alkoxylated alcohols) | 10 to 50 |
| KOH (45%) | pH 7.5-14 |
| Sodium Silicate | 5 to 90 |
| Sodium Tripolyphosphate | 0 to 60 |
| Water | 10 to two million |

EXAMPLE B

| Components | Parts by Weight |
|---|---|
| Alkanol amide | 10 |
| Dodecyl Benzene Sulfonic Acid amine salt | 40 |
| Neodol ($C_{12}$-$C_{15}$ Alcohol Ethoxylate) | 20 |
| KOH (45%) | pH 12 |
| Sodium Tripolyphosphate | 30 |
| Water | 1,000 |

EXAMPLES 1-5

| | Parts By Weight | | | | |
|---|---|---|---|---|---|
| Composition I | 1 | 2 | 3 | 4 | 5 |
| Ethanolamide | 7.15 | | 10.31 | | |
| Triethanolamine | .95 | | 1.35 | | |
| Sodium Dodecyl-benzene Sulfonate | .95 | | 1.35 | | |
| Sodium Xylene Sulfonate | .95 | .95 | .95 | | |
| Potassium Hydroxide (45%) | 48.00 | 48.00 | | | |
| Neodol 25-7 | 4.00 | 13.05 | | | |
| Commercial Detergent (Fergeson 54-63) | | | | 62.05 | |
| Water | 10,000 | 10,000 | 10,000 | 10,000 | 10,000 |
| Cleaning Evaluation | B | C | C | C | D |

EXAMPLES 6–10

| Composition III | Parts By Weight 6 | 7 | 8 | 9 | 10 |
|---|---|---|---|---|---|
| Triethanolamine | 0.8 | | 1.2 | | |
| Dodecylbenzene Sulfonic Acid | 1.6 | | 2.4 | | |
| Miranol FBS | 1.6 | | 2.4 | | |
| Clindral 202 CGN (Alkanolamide) | 2.0 | | 18.0 | | |
| Sodium Tripoly Phosphate | 10.0 | 10.0 | | | |
| P.Q. Soluble Sodium Silicate | 30.0 | 30.0 | | | |
| Potassium Hydroxide (45%) | 32.0 | 32.0 | | | |
| Neodol 25-9 | 8.0 | 24.0 | | | |
| Commercial Detergent | | | | 86.0 | |
| Water | 10,000 | 10,000 | 10,000 | 10,000 | 10,000 |
| Cleaning Evaluation | A | B | B | B | D |

EXAMPLES 11–15

| Composition IV | Parts By Weight 11 | 12 | 13 | 14 | 15 |
|---|---|---|---|---|---|
| Alakanolamide | 18.59 | | 20.78 | | |
| Triethanolamine | 24.70 | | 27.61 | | |
| Dodecyl Benzene Sulfonic Acid | 24.70 | | 27.61 | | |
| Sodium Xylene Sulfonate | 44.70 | 44.70 | 44.70 | | |
| Potassium Hydroxide (45%) | 32.00 | 32.00 | | | |
| P.Q. Soluble Sodium Silicate | 16.00 | 16.00 | | | |
| Sodium Tripoly Phosphate | 10.00 | 10.00 | | | |
| Neodol 91-2.5 | 4.00 | 38.00 | | | |
| Neodol 91-6.0 | 4.00 | 38.00 | | | |
| Commercial Detergent | | | | 178.69 | |
| Water | 10,000 | 10,000 | 10,000 | 10,000 | 10,000 |
| Cleaning Evaluation | A | B | B | C | D |

EXAMPLES 16–20

| Composition | Parts By Weight 16 | 17 | 18 | 19 | 20 |
|---|---|---|---|---|---|
| Alakanolamide | 7.15 | | 13.47 | | |
| Triethanolamine | .95 | | 1.79 | | |
| Dodecyl Benzene Sulfonic Acid | .95 | | 1.79 | | |
| Sodium Xylene Sulfonate | 10.95 | 10.95 | 10.95 | | |
| Potassium Hydroxide (45%) | 32.00 | 32.00 | | | |
| Sodium Tripoly Phosphate | 10.00 | 10.00 | | | |
| Neodol 25-7 | 8.00 | 17.05 | | | |
| Commercial Detergent | | | | 70.00 | |
| Water | 10,000 | 10,000 | 10,000 | 10,000 | 10,000 |
| Cleaning Evaluation | A | B | B | B | D |

EXAMPLES 21–25

| Composition VI | Parts By Weight 21 | 22 | 23 | 24 | 25 |
|---|---|---|---|---|---|
| Alakanolamide | 12.78 | | 15.70 | | |

-continued

| Composition VI | Parts By Weight 21 | 22 | 23 | 24 | 25 |
|---|---|---|---|---|---|
| Triethanolamine | 2.66 | | 3.24 | | |
| Dodecyl Benzene Sulfonic Acid | 2.66 | | 3.24 | | |
| Sodium Xylene Sulfonate | 9.00 | 9.00 | 9.00 | | |
| Potassium Hydroxide (45%) | 28.00 | 28.00 | | | |
| Sodium Hydroxide (50%) | 9.00 | 9.00 | | | |
| Neodol 25-7 | 4.00 | 22.19 | | | |
| Commercial Detergent | | | | 68.10 | |
| Water | 10,000 | 10,000 | 10,000 | 10,000 | 10,000 |
| Cleaning Evaluation | A | B | C | C | D |

EXAMPLES 26–30

| Composition VII | Parts By Weight 26 | 27 | 28 | 29 | 30 |
|---|---|---|---|---|---|
| Alakanolamide | 14.38 | | 10.6 | | |
| Triethanolamine | 1.9 | | 2.7 | | |
| Dodecyl Benzene Sulfonic Acid | 1.9 | | 2.7 | | |
| Sodium Xylene Sulfonate | 11.9 | 11.9 | 11.9 | | |
| Sodium Tripoly Phosphate | 10.0 | 10.0 | | | |
| P.Q. Soluble Sodium Silicate | 16.0 | 16.0 | | | |
| Potassium Hydroxide (45%) | 32.0 | 32.0 | | | |
| Neodol 91-2.5 | 4.0 | 13.1 | | | |
| Neodol 91-6.0 | 4.0 | 13.1 | | | |
| Commercial Detergent | | | | 96.08 | |
| Water | 10,000 | 10,000 | 10,000 | 10,000 | 10,000 |
| Cleaning Evaluation | A | B | B | C | D |

EXAMPLES 31–35

| Composition | Parts By Weight 31 | 32 | 33 | 34 | 35 |
|---|---|---|---|---|---|
| Alakanolamide | 18.59 | | 20.78 | | |
| Triethanolamine | 24.70 | | 27.61 | | |
| Dodecylbenzene Sodium Sulfonate | 24.70 | | 27.61 | | |
| Sodium Xylene Sulfonate | 44.70 | 44.70 | 44.70 | | |
| Potassium Hydroxide (45%) | 32.00 | 32.00 | | | |
| P.Q. Soluble Sodium Silicate | 16.00 | 16.00 | | | |
| Sodium Tripoly Phosphate | 10.00 | 10.00 | | | |
| Neodol 91-2.5 ($C_9$–$C_{11}$ alcohol 2.5-ethoxylate) | 4.00 | 38.00 | | | |
| Neodol 91-6.0 ($C_9$–$C_{11}$ alcohol ethoxylate) | 4.00 | 38.00 | | | |
| Commercial Detergent | | | | 178.69 | |
| Water | 10,000 | 10,000 | 10,000 | 10,000 | 10,000 |
| Cleaning Evaluation | A | B | B | C | D |

While this invention has been described by a specific number of embodiments, it is obvious that there are other variations and modifications which can be made without departing from the spirit and scope of the invention as set forth in the appended claims.

The invention claimed is:

1. A method of cleaning substrates which comprises treating the substrate with an acidic aqueous solution having a pH below about 6.5 comprising at least amphoteric or nonionic detergent, and subsequently washing said treated substrate with an alkaline detergent comprising an aqueous solution of from about 10 to 50 parts by weight of an alkoxylated nonionic surfactant, about 10 to 90 parts by weight of an anionic detergent having at least 12 carbon atoms per molecule selected from the group consisting of sulfonates and sulfates, about 5 to 90 parts by weight of a metal salt of a lower molecular weight polycarboxylic acid, about 1 to 30 parts by weight of a water-soluble tertiary amine oxide and an effective amount of at least one alkaline metal hydroxide to maintain the aqueous solution at a pH greater than 7.5.

2. The method of claim 1 further characterized in that the alkaline detergent has a pH above 9.0.

3. The method of claim 2 further characterized in that the alkaline detergent comprises from about 20 to 40 parts by weight of the non-ionic surfactant, about 60 to 80 parts by weight of the anionic detergent and 100 to one million parts by weight of water.

4. The method of claim 3 further characterized in that the alkali metal hydroxide is a mixture of sodium and potassium hydroxides.

5. The method of claim 1 further characterized in that the acidic aqueous solution contains a non-ionic alkoxylated detergent.

6. The method of claim 1 further characterized in that the alkaline detergent is applied to the substrate at nozzle pressures ranging from about 50 psi to 600 psi.

7. The method of claim 1 further characterized in that the substrate is treated with the acidic aqueous solution at nozzle pressures ranging from asbout 50 psi to 600 psi.

8. The method of claim 6 further characterized in that the nozzle pressure ranges from about 100 psi to 600 psi.

* * * * *

UNITED STATES PATENT AND TRADEMARK OFFICE

CERTIFICATE OF CORRECTION

PATENT NO. : 4,683,008

DATED : July 28, 1987

INVENTOR(S) : Betts

It is certified that error appears in the above-identified patent and that said Letters Patent is hereby corrected as shown below:

Column 6, Line 11, "400" should be --400 psi--.

Column 7, Line 48 "Composition" should be --Composition V--.

Column 8, Line 44 "Composition" should be --Composition VIII--.

Column 10, Line 17 "asbout" should be --about--.

Signed and Sealed this

Twenty-ninth Day of March, 1988

*Attest:*

DONALD J. QUIGG

*Attesting Officer*

*Commissioner of Patents and Trademarks*